United States Patent [19]

Lambert

[11] Patent Number: 4,712,688

[45] Date of Patent: Dec. 15, 1987

[54] DOUBLE BREAKAPART CARTON WITH SEALABLE ENDS AND BLANK FOR FORMING THE SAME

[75] Inventor: Herbert L. Lambert, West Chicago, Ill.

[73] Assignee: Waldorf Corporation, St. Paul, Minn.

[21] Appl. No.: 711,285

[22] Filed: Mar. 13, 1985

[51] Int. Cl.[4] ..... B65D 5/54

[52] U.S. Cl. ..... 206/602; 206/623; 229/103; 229/164; 229/DIG. 9; 229/120.09

[58] Field of Search ..... 206/602, 623, 45.11, 206/45.12, 45.31; 229/DIG. 9, 27, 29 R, 29 B, 37 R, 17 R, 16 D, 103, 164, 172, 15

[56] References Cited

U.S. PATENT DOCUMENTS

| | | | |
|---|---|---|---|
| 1,999,909 | 4/1935 | Lupton | 229/15 |
| 2,048,729 | 7/1936 | Daller | 229/DIG. 9 |
| 2,565,682 | 8/1951 | Guyer | 229/DIG. 9 |
| 2,678,724 | 5/1954 | Andriot, Jr. | 229/27 |
| 3,021,046 | 2/1962 | Pullen | 206/423 X |
| 3,082,929 | 3/1963 | Aquino et al. | 229/27 |
| 4,083,879 | 4/1978 | Capo | 206/623 |
| 4,377,237 | 3/1983 | Pawlowski | 206/602 X |
| 4,392,605 | 7/1983 | Backman | 229/19 |

FOREIGN PATENT DOCUMENTS

| | | | |
|---|---|---|---|
| 1117295 | 6/1968 | United Kingdom | 206/602 |

*Primary Examiner*—Stephen Marcus
*Assistant Examiner*—Bryon Gehman
*Attorney, Agent, or Firm*—Dorsey & Whitney

[57] ABSTRACT

A double breakapart carton, and the blank for forming the same, include a plurality of sides having end flaps hingedly attached on their ends. The end flaps are designed to be overlapped when folded in the closed position to seal off both ends of the container. A perforated line is located midway between the top and bottom ends of the container. The perforated line extends across all the sides of the container except one. The side without the perforated line includes two partial panels which are spaced apart and which have intermediate ends facing each other. The carton includes intermediate closure flaps hingedly attached to these intermediate ends. The intermediate closure flaps, when folded inwardly, close off the container intermediate of its ends. The carton can be separated along the perforated line forming two identical containers having a sealed end and an end closeable by the intermediate closure flaps.

16 Claims, 9 Drawing Figures

FIG. 1
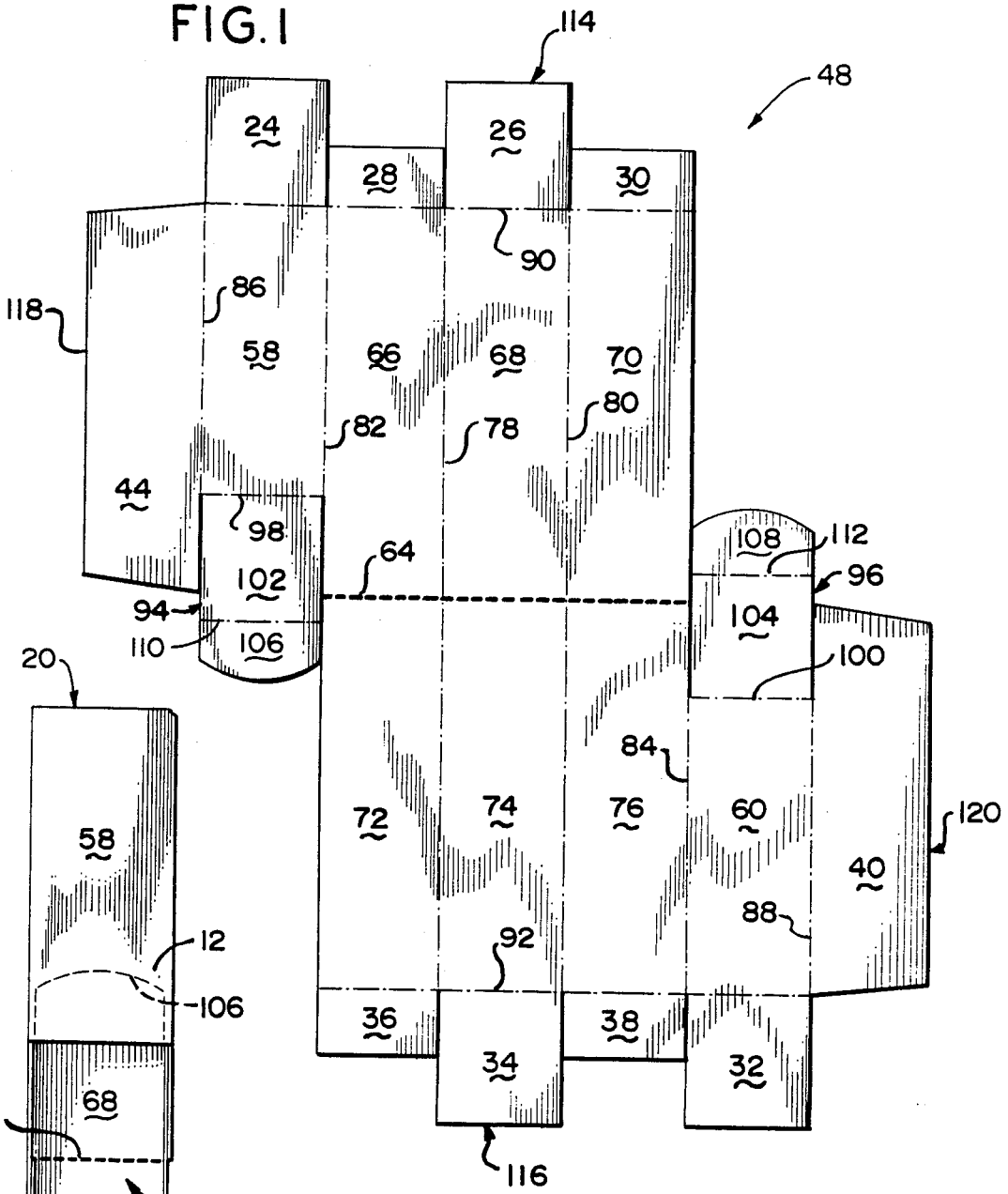
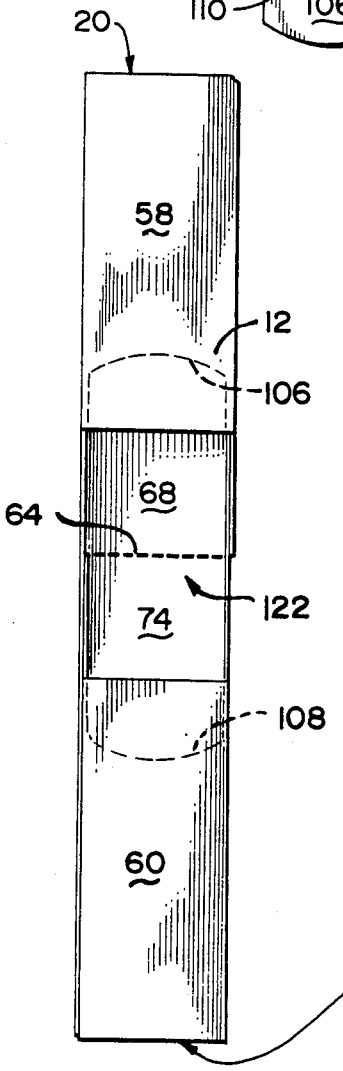
FIG. 6

FIG. 7
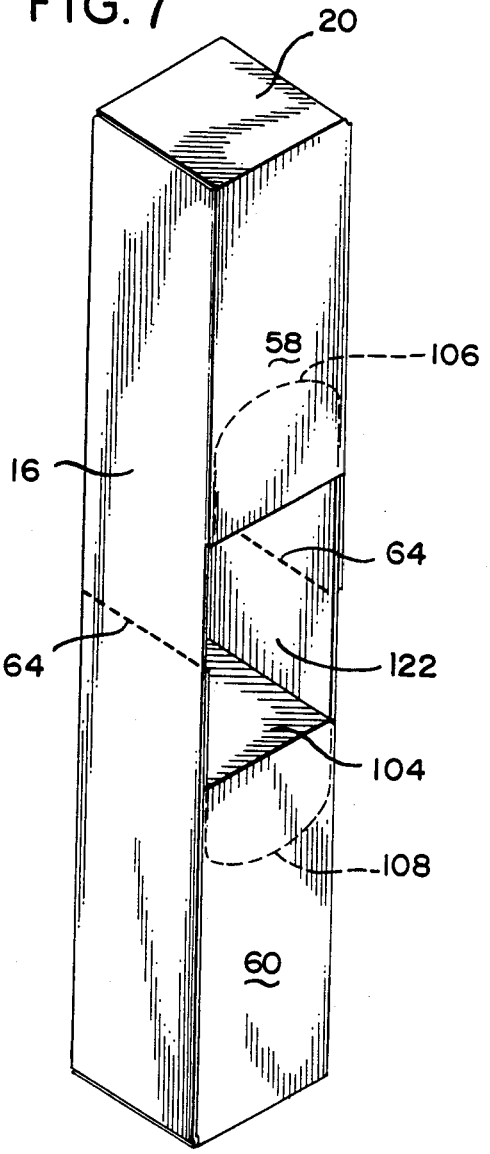
FIG. 8
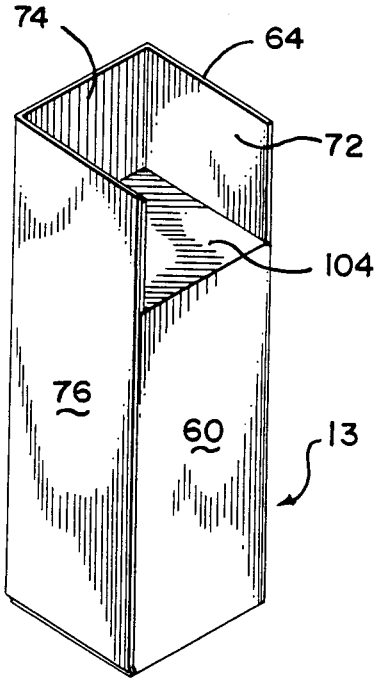
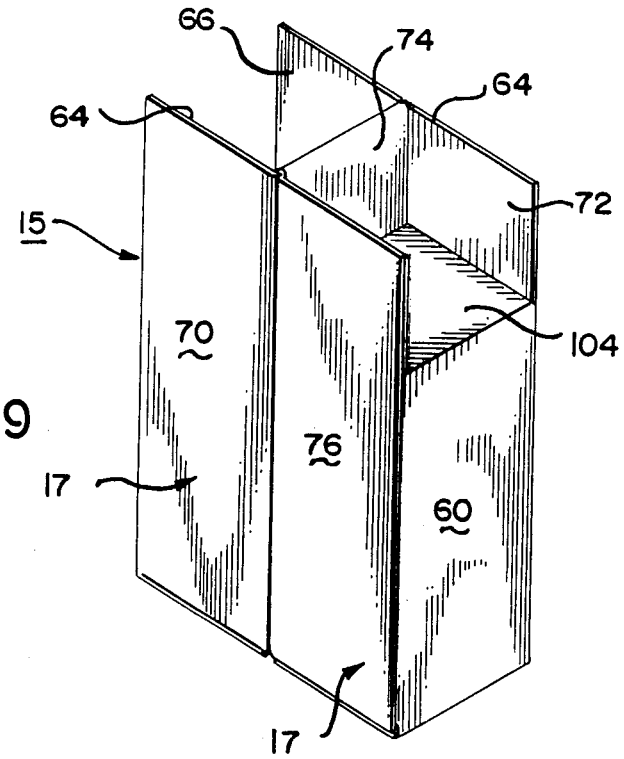
FIG. 9

DOUBLE BREAKAPART CARTON WITH SEALABLE ENDS AND BLANK FOR FORMING THE SAME

FIELD OF THE INVENTION

This invention relates to double breakapart cartons and blanks for forming the cartons wherein two identical containers are formed from each carton when the carton is broken apart. More particularly, this invention relates to such cartons wherein sealable ends are formed at opposite ends of the carton, and foldable ends are formed intermediate the ends of the cartons.

BACKGROUND OF THE INVENTION

Paperboard cartons are widely used to package a variety of consumer products. Paperboard cartons, as compared to other types of packaging, are relatively inexpensive, attractive, and convenient. Moreover, paperboard cartons are relatively inexpensive since the material, paperboard, is relatively inexpensive compared to other packaging materials and can be easily formed into a container. Paperboard cartons are relatively attractive since they can be designed in appealing shapes or can have attractive designs printed thereon. They are convenient because they are easy to handle and to open and shut.

Having a container that is inexpensive, attractive and convenient is highly desirable for all consumer products. Often, a container alone can attract buyers, especially if the container design is unique or particularly attractive. This is particularly true for children's products. Children are more likely to be attracted to a product if its container is attractive and appealing.

Often, children will be enticed to buy products such as gum balls, jawbreakers, or other hard or chewable candy based on the container. The container can have printer matter which is especially appealing to the child, such as a picture of the child's favorite television or cartoon character. Also, the uniqueness of the container can entice children.

For products such as hard and chewable candy, the container should be easy to carry and sized to fit in pockets of children's clothing. If the container is designed so that children will be able to easily carry the container with them wherever they go, consumption of the product will be encouraged. Moreover, these containers must be easy to open and close so that children will not become frustrated.

It is also desirable to have multi-pack containers so that children will buy more than one container of the candy at one time. This may increase sales of the product since buyers will buy more than one container of the product at a time. Each such multi-pack container must be designed so that each individual container has a closeable end.

SUMMARY OF THE INVENTION

An object of the present invention is to provide a carton, which is inexpensive, attractive and convenient to use.

Another object of this invention is to provide a carton, and a blank for forming the same, which includes a multiple package of the product.

Yet another object of this invention is to provide a multi-pack carton wherein the individual packages fit in the pockets of children's clothing.

A further object of this invention is to provide a container, and a blank for forming the same, for gumballs, jawbreakers or other hard or chewable candy which is attractive in its structure to potential consumers.

Still another object of this invention is to provide a multi-pack carton, and a blank for forming the same, wherein the individual containers may be easily opened and easily closed.

A further object of this invention is to provide a double breakapart carton wherein both containers have sealed ends and closeable ends.

A still further object of this invention is to provide a double breakapart carton which is easy to breakapart, and when broken apart forms two identical containers having sealed and closeable ends.

The foregoing objects are achieved by providing a carton formed from a foldable blank comprising a plurality of sides defining a tube, each of the sides having first and second ends; end flaps coupled to the sides and closing the ends; first and second intermediate closure flaps formed in and hingedly coupled to one of the sides along intermediate closure fold lines between the ends; the intermediate closure flaps extending in oppsosite directions; and, a common perforated line in the other of the sides intermediate the ends and adjacent the intermediate closure flaps; whereby, the other sides can be separated along said common perforated line forming open ends closeable by the intermediate closure flaps.

In some embodiments of this invention, the end flaps overlap when closing the ends and are secured by an adhesive in the closed position.

In certain embodiments, the carton has four sides of equal width. The end flaps are comprised of two pairs of matching flaps, one pair of the flaps being hingedly connected to the first and third sides and the second pair of flaps being hingedly connected to the second and fourth sides.

In other embodiments, the perforated line is located midway the ends of the cartons and divides the carton into two containers.

The objects of this invention are also achieved by a unitary blank formed of paperboard and adapted to be folded into a carton, comprising a first full length panel; second and third full length panels hingedly coupled to opposite sides of the first full length panel along fold lines; a lateral weakened line in the full length panels dividing each of the full length panels into top and bottom half panels; first and second partial panels hingedly coupled to the second and third full length panels at edges opposite the first full length panel along longitudinal fold lines; the first partial panel being laterally adjacent the top half panel of the second full panel; the second partial panel being laterally adjacent the bottom half panel of the third full panel; and, first and second intermediate closure flaps hingedly coupled to the partial panels at intermediate closure fold lines perpendicular to said longitudinal fold lines.

In certain embodiments of the blank, the weakened line is a perforated line located midway between the ends of the full length panels to divide the full length panels into identical top and bottom half panels.

In further embodiments of this invention, the partial panels have a length less than the length of the half panels which are adjacent to the perforated line.

Further embodiments of the unitary blank according to this invention may include first and second glue panels (or flaps) which are hingedly attached on the outer longitudinal edges of the first and second partial panels, respectively. These glue panels may be designed to fold over one of the full length panels in surface-to-surface contact to form a closed container.

Other objects, advantages and salient features of the present invention will become apparent to those skilled in the art once given the following detailed description.

As used in this application, the terms "bottom", "side", "top", "front", and "back" are intended to facilitate the description of the carton and blank for forming the carton. Thus, such terms are merely illustrative of the carton and are not intended to limit the carton or the blank to any specific orientation.

BRIEF DESCRIPTION OF THE DRAWINGS

Referring to the drawings:

FIG. 1 is a top view of a blank for forming a carton according to this invention.

FIG. 6 is a front elevational view of the container illustrated in FIGS. 2–5 with all the flaps in their respective closed positions.

FIG. 7 is a perspective view of the carton illustrated in FIGS. 2–6.

FIG. 8 is a perspective view of an individual container or package formed by separating the carton illustrated in FIGS. 2–7 along its perforated line.

FIG. 9 is a perspective view of the carton illustrated in FIGS. 2–7 after the carton has been broken apart along its side walls and folded 180° along the perforated line in its back wall.

DETAILED DESCRIPTION OF THE PREFERRED EMBODIMENT

Figure 2:
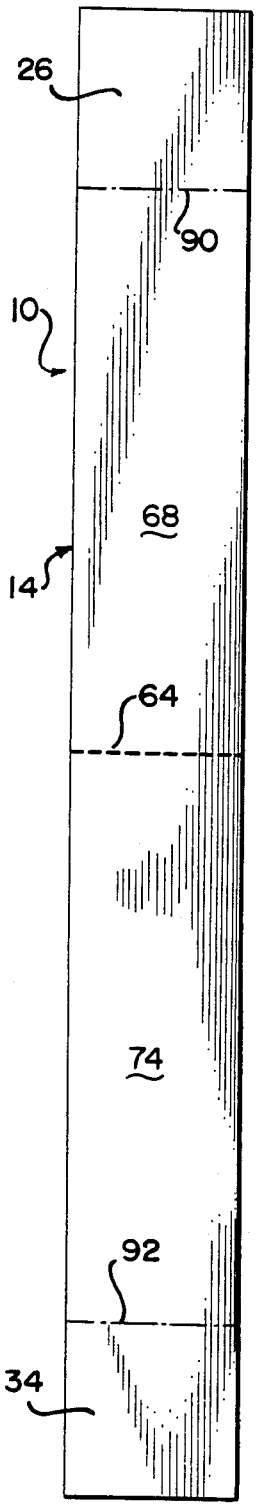
FIG. 2 is a rear elevational view of a carton according to this invention, with the end flaps in their respective open positions.
Figure 3:
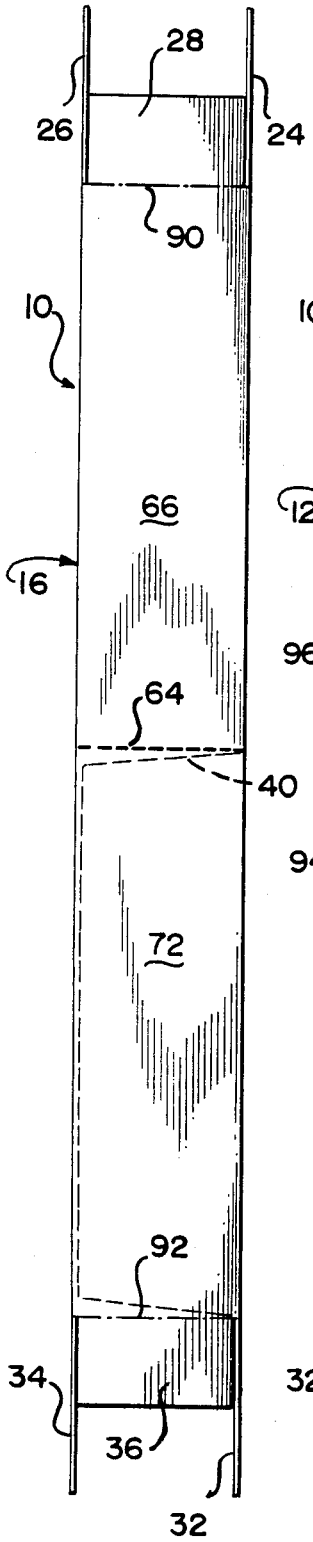
FIG. 3 is a side elevational view of the left side of the carton illustrated in FIG. 2, also with all the flaps in their respective open positions.

Referring to the Figures, in particular FIGS. 2–5, an embodiment of a carton according to this invention is illustrated. For convenience of explanation, FIGS. 2–5 show the carton 10 assembled as a tube but without having any of its end flaps folded in place for closure. Double breakapart carton 10 includes front side 12, comprising partial panels 58 and 60 and intermediate closure flaps 94, 96; back side 14, comprising half panels 68 and 74; left side 16, comprising half panels 66 and 72 and glue flap 40; and right side 18, comprising half panels 70 and 76 and glue flap 44. Sides 12, 14, 16 and 18 are rectangular, all the same width and hingedly attached at adjacent longitudinal edges to form a container with a square cross section.

Carton 10 also includes a top end 20 and a bottom end 22 (see FIG. 6). Top end 20 comprises flaps 24, 26, 28 and 30 hingedly attached to panels 58, 68, 66 and 70, respectively, along fold line 90. Bottom end 22 comprises flaps 32, 34, 36 and 38 hingedly connected to the bottom edges of panels 60, 74, 72 and 76, respectively, along fold line 92. Flaps 24, 26, 32 and 34 are square and flaps 28, 30, 36 and 38 are rectangular.

Side 16 (see FIG. 3) includes flap 40 (indicated by dashed lines) which overlaps with half panel 72 and is glued in surface-to-surface contact with half panel 72. Likewise, side 18 (see FIG. 5) includes flap 44 which is adhered in surface-to-surface contact with half panel 70. Flaps 40 and 44 retain container 10 in its box configuration.

Figure 4:
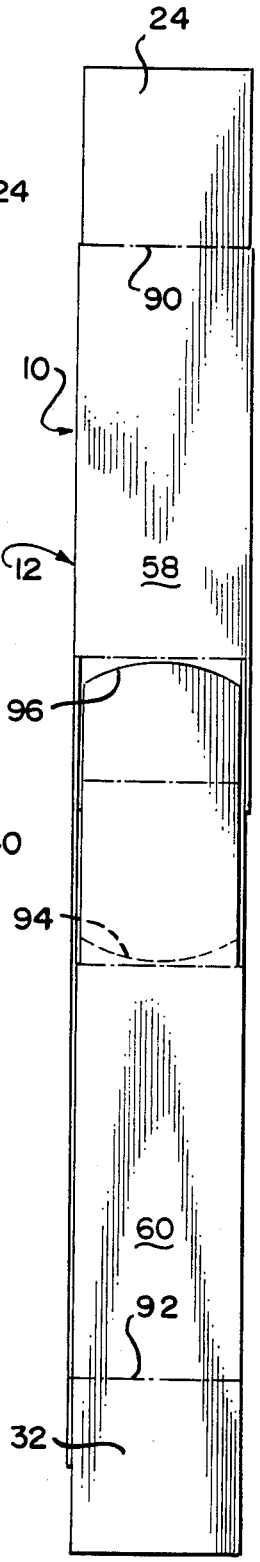
FIG. 4 is a front elevational view of the embodiment of this invention illustrated in FIGS. 2 and 3, with the top, bottom and intermediate closure flaps all in their respective open positions.
Figure 5:
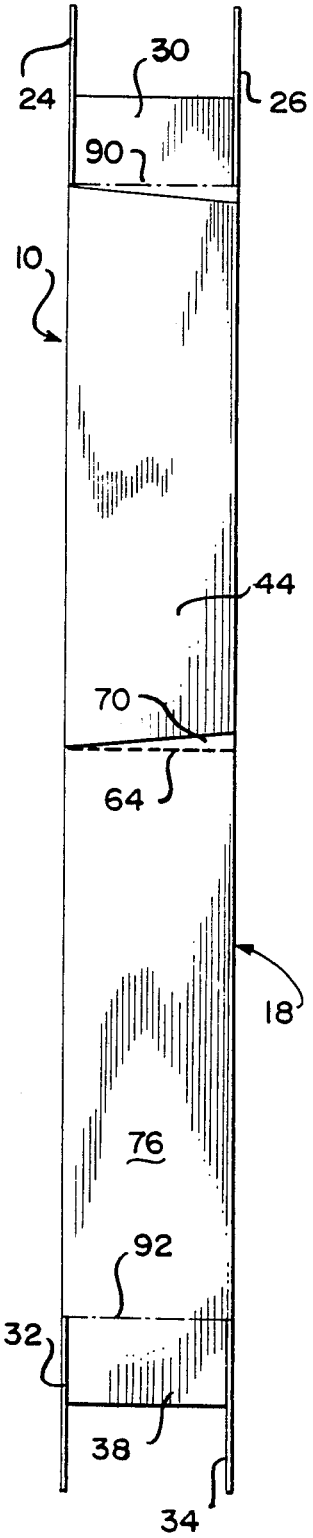
FIG. 5 is a side elevational view of the right side of the embodiment of this invention illustrated in FIGS. 2–4, also with all the flaps in their respective open positions.

Front side 12 of the carton 10 in tubular form as seen in FIGS. 2–5 includes a pair of overlapping intermediate closure flaps, lower intermediate closure flaps 96 and upper intermediate closure flap 94 (shown in FIG. 4 by dashed lines). Flaps 94 and 96 are designed to be folded at their respective fold lines 110, 112 (see FIG. 1) and pushed in to close off two intermediate openings in carton 10, as described in more detail below.

Left side 16, back side 14 and right side 18 have a perforation line 64 located midway between their respective ends in a plane distinct from the plane of either intermediate closure flap 94, 96. When carton 10 is completely separated along perforation line 64 and when flaps 24–38 are closed, two identical containers are formed, one of which, container 13, is illustrated in FIG. 8. Also, carton 10 may be separated along any two of its perforated sides 14–18 and folded along the remaining untorn perforated side. As illustrated in FIG. 9, when carton 10 is separated along its sides 16 and 18 and folded 180° along fold line 64 of side 14, a multi-pack container 15 is achieved having two identical containers 17.

Carton 10 is formed from planar, unitary blank 48 illustrated in FIG. 1. Blank 48 includes three full length panels made up of half panel pairs 66/72, 68/74 and 70/76 and further includes two partial length panels 58, 60. All half and partial panels are rectangular in shape. Perforation line 64 extends across the width of the full length panels midway between their ends and divides these panels into top half panels 66, 68 and 70 and bottom half panels 72, 74 and 76, respectively. In some embodiments, perforation line 64 can be replaced by a line weakened in some manner, or by a line partially perforated and partially weakened in some other manner.

The various panels are hingedly connected as follows: joined half panels 66, 72 are hingedly connected to joined half panels 68, 74 along longitudinal fold line 78. Joined half panels 70, 76 are hingedly attached to the other edge of joined half panels 68, 74 along longitudinal fold line 80. Partial panel 58 is hingedly attached to top half panel 66 along longitudinal fold line 82 and partial panel 60 is hingedly attached to bottom half panel 76 along longitudinal fold line 84. In addition, flap 44 is hingedly attached to partial panel 58 along longitudinal fold line 86 and flap 40 is hingedly attached to partial panel 60 along longitudinal fold line 88. Flaps 40 and 44 taper inwardly from fold lines 88 and 86, respectively, and are of a length and width less than the half panels so that flaps 40 and 44 can be more readily folded.

Blank 48 also includes flaps 24–38 as discussed above. Top flaps 24, 28, 26 and 30 are hingedly connected to the top edges of partial panel 58, top half panel 66, top half panel 68, and top half panel 70, respectively, along fold line 90. Bottom flaps 36, 34, 38 and 32 are hingedly connected to the bottom edges of bottom half panel 72, bottom half panel 74, bottom half panel 76 and partial panel 60, respectively, along fold line 92.

Blank 48 also includes intermediate closure flaps 94 and 96 connected to the bottom edge of partial panel 58 and the top edge of partial length panel 60 along intermediate closure fold lines 98 and 100, respectively. Intermediate closure flaps 94 and 96 include closing panels 102 and 104 and tabs 106 and 108, respectively. Closing panels 102 and 104 are of a square shape having the same dimensions as the opening in container 10 so that closing panels 102 and 104 can close container 10 when folded in the closed position. Tabs 106 and 108 are hingedly connected to closing panels 102 and 104 along fold lines 110 and 112, respectively.

When blank 48 is configured as in FIG. 1, it has a top edge 114 formed by the top edge of flaps 24–30, a bottom edge 116 formed by bottom edges of bottom flaps 32–38, a side edge 118 formed by the free edge of flap 44, and a side edge 120 formed by the free edge of flap 40.

To form carton 10 from blank 48, the various full length and partial panels and flaps 40 and 44 are all folded at right angles along longitudinal fold lines 86, 82, 78, 80 and 84 and wrapped together. When this is done, flap 40 will overlap with bottom half panel 72 and flap 44 will overlap with top half panel 70. Flaps 40 and 44 can then be glued or otherwise attached to half panels 72 and 70, respectively, to form a box or tube.

Then, top flaps 24–30 are folded downward and attached, thus closing off the top end of container 10, and bottom flaps 32–38 are folded upward and attached together, thus closing off the bottom end of container 10. Next, intermediate closure flaps 94 and 96 are folded 90° inward along intermediate closure fold lines 98, 100, respectively, such that closing panels 102 and 104 lie perpendicular to the cross section of carton 10, thus closing off carton 10 intermediate of its ends. Tabs 106 and 108 are folded 90° inward along fold lines 110, 112, respectively, with respect to closing panels 102 and 104 such that tab 106 is directed upward and tab 108 is directed downward (see FIG. 6). When intermediate closure flaps 94 and 96 are placed in the closed positions, a window 122 is formed in front side 12 of container 10 (see FIG. 6), because the flaps 94, 96 line in planes distinct from and displaced from the plane of perforated line 64.

Container 10 can then be torn apart along perforation line 64, resulting in two identical containers 13, as discussed above, having sealed bottom ends and top ends closed by intermediate closure flaps 94 and 96. Flaps 94 and 96 can be easily opened and closed by pulling up and pushing down thereon. Also, if desired, two of the three perforated sides 14–18 may be separated with the third side being left intact. Carton 10 can then be folded along the untorn portion of perforated line 64, forming two identical containers 17.

FIG. 9 illustrates a carton 10 wherein the sides 16 and 18 have been separated and the carton has been folded 180° along the portion of perforated line 64 which bisects back side 14, forming two identical containers 17 in back-to-back relationship. One of the containers 17 is formed of bottom flaps 32–38, partial panel 60, bottom half panels 72–76 and intermediate closure flap 96. The second container 17 is formed of top flaps 24–30, partial panel 58, top half panels 66–70 and intermediate closure flap 94.

Once given this disclosure, other embodiments, modifications and improvements will become apparent to those skilled in the art. Such other embodiments, modifications or improvements are considered to be within the scope of this invention as defined by the following claims.

What is claimed is:

1. A carton formed from a foldable blank, comprising:

a plurality of sides defining a tube, said tube and sides having first and second ends;

end flaps coupled to said sides and closing said tube ends;

first and second intermediate closure flaps formed in and hingedly coupled to one of said side along separate intermediate closure fold lines that span said side between the ends of said side, said intermediate closure flaps extending from and being foldable at their respective intermediate closure fold lines to lie substantially perpendicular to said one side; and a common perforated line in the remaining sides intermediate the ends of said remaining sides and adjacent said intermediate closure flaps, the plane of said common perforated line being distinct from either intermediate closure fold line associated with an intermediate closure flap;

whereby, the remaining sides can be separated along said common perforated line, forming two additional open tube ends each of which is fully closeable by one of said intermediate closure flaps when said flaps are folded to lie substantially perpendicular to said one side and each of which is open when said intermediate closure flaps are positioned to lie in the plane of said one side.

2. A carton according to claim 1 wherein said end flaps overlap when closing said tube ends.

3. A carton according to claim 1 wherein said end flaps are secured by an adhesive in the closed position.

4. A carton according to claim 1 wherein said carton has four sides.

5. A carton according to claim 4 wherein said sides are of equal width.

6. A carton according to claim 1 wherein said perforated line is located midway between the ends of the tube.

7. A carton formed from a foldable blank, comprising:

a plurality of sides defining a tube, said tube and sides having first and second ends;

end flaps coupled to said sides and closing said tube ends;

first and second intermediate closure flaps formed in and hingedly coupled to one of said sides along separate intermediate closure fold lines that span said side between the ends of said side, said intermediate closure flaps extending from and being foldable at their respective intermediate closure fold lines to lie substantially perpendicular to said one side, with said intermediate closure flaps being at least partially overlapped when positioned to lie in the plane of said one side, said intermediate closure flaps further comprising closing panels which lie perpendicular to the longitudinal axis of the tube and tabs which extend parallel to the longitudinal axis of the tube when the intermediate closure flaps are in the closed position; and a common perforated line in the remaining sides intermediate the ends of said remaining sides and adjacent said intermediate closure flaps, the plane of said common perforated line being distinct from either intermediate closure fold line associated with an intermediate closure flap;

whereby, the remaining sides can be separated along said common perforated line, forming two additional open tube ends, each of which is fully closeable by one of said intermediate closure flaps when said flaps are folded to lie substantially perpendicular to one side and each of which is open when said intermediate closure flaps are positioned to lie in the plane of said one side.

8. A carton according to claim 7 wherein said carton is designed such that when at least two of the remaining sides of the carton are separated, two identical containers are formed.

9. A unitary blank formed of paperboard and adapted to be folded into a carton, comprising:

a first full length panel;

second and third full length panels hingedly coupled to opposite sides of said first full length panel along fold lines;

a lateral weakened line in said full length panels dividing each of said full length panels into top and bottom half panels;

a first and a second partial panel hingedly coupled to said second and third full length panels, respectively, at longitudinal fold lines opposite said first full length panel, said first partial panel being laterally adjacent said top half panel of said second full length panel and said second partial panel being laterally adjacent said bottom half panel of said third full length panel; and first and second intermediate closure flaps hingedly coupled to said first and second partial panels, respectively, at intermediate closure fold lines perpendicular to said longitudinal fold lines and parallel to each other along an edge of said partial panels.

10. A unitary blank according to claim 9 wherein the weakened line is a perforated line.

11. A unitary blank according to claim 9 wherein said partial panels have a length less than the length of said half panels.

12. A unitary blank according to claim 9 wherein a first and a second glue flap are hingedly attached to said first and second partial panels, respectively, at fold lines opposite the longitudinal fold lines that couple said partial panels to said second and third full panels.

13. A unitary blank according to claim 12 wherein said glue flaps are of a width and length less than said half panels.

14. A unitary blank according to claim 9 further comprising end flaps on the ends of said full length panels.

15. A unitary blank according to claim 9 wherein said intermediate closure flaps comprise closing panels and tabs;

said closing panels are square;

said closing panels are hingedly attached at the intermediate closure fold lines along an edge of the partial panels; and said tabs are hingedly attached to the closing panels at fold lines opposite and parallel to the intermediate closure fold lines.

16. A unitary blank according to claim 9 wherein said top and bottom half panels are of equal length.

* * * * *